US005712237A

United States Patent [19]

Stevens

[11] Patent Number: 5,712,237

[45] Date of Patent: Jan. 27, 1998

[54] COMPOSITION FOR CLEANING TEXTILES

[76] Inventor: Edwin B. Stevens, 30 Brookside Rd., West Orange, N.J. 07052

[21] Appl. No.: 563,176

[22] Filed: Nov. 27, 1995

[51] Int. Cl.[6] ..... C11D 3/20; C11D 3/44; C11D 1/72

[52] U.S. Cl. ..... 510/291; 510/289; 510/356; 510/365; 510/422; 510/421; 510/506; 510/505; 510/285; 510/276; 510/405

[58] Field of Search ..... 510/289, 356, 510/365, 422, 421, 506, 505, 285, 276, 405, 291

[56] References Cited

U.S. PATENT DOCUMENTS

| | | | |
|---|---|---|---|
| 4,180,472 | 12/1979 | Mitchell et al. | 252/162 |
| 4,199,482 | 4/1980 | Renaud et al. | 252/559 |
| 4,405,511 | 9/1983 | Hasenclever | 252/547 |
| 4,406,809 | 9/1983 | Hasenclever | 252/106 |
| 4,460,374 | 7/1984 | Abel et al. | 8/501 |
| 4,659,332 | 4/1987 | Hellsten | 8/142 |
| 4,755,451 | 7/1988 | Le et al. | 430/331 |
| 4,867,800 | 9/1989 | Dishart et al. | 134/40 |
| 4,968,447 | 11/1990 | Dixon et al. | 252/174.23 |
| 5,011,620 | 4/1991 | Dishart et al. | 252/118 |
| 5,031,648 | 7/1991 | Lutener et al. | 134/32 |
| 5,061,393 | 10/1991 | Linares et al. | 252/143 |
| 5,062,988 | 11/1991 | Dishart et al. | 252/170 |
| 5,064,557 | 11/1991 | Fusiak | 252/162 |
| 5,081,772 | 1/1992 | Wyman | 134/40 X |
| 5,084,200 | 1/1992 | Dishart et al. | 252/173 |
| 5,096,501 | 3/1992 | Dishart et al. | 134/10 |
| 5,103,730 | 4/1992 | Sarda | 101/425 |
| 5,146,938 | 9/1992 | Lutener et al. | 134/32 |
| 5,238,587 | 8/1993 | Smith et al. | 252/8.6 |
| 5,308,550 | 5/1994 | Friloux | 252/544 |
| 5,324,443 | 6/1994 | Arif et al. | 252/142 |
| 5,334,260 | 8/1994 | Stefanowski | 148/23 |
| 5,370,742 | 12/1994 | Mitchell et al. | 134/10 |
| 5,531,933 | 7/1996 | Masters et al. | 510/429 |
| 5,561,105 | 10/1996 | Honda | 510/178 |
| 5,597,792 | 1/1997 | Klier et al. | 510/417 |
| 5,612,303 | 3/1997 | Takayanagi et al. | 510/174 |

FOREIGN PATENT DOCUMENTS

| | | |
|---|---|---|
| 1043955 | 7/1990 | China . |
| 75546 | 3/1983 | European Pat. Off. . |
| 0 479 146 | 4/1992 | European Pat. Off. . |
| 648820 | 4/1995 | European Pat. Off. . |
| 63-184000 | 7/1988 | Japan . |
| 2251669 | 10/1990 | Japan . |
| 4076099 | 3/1992 | Japan . |
| 5098293 | 4/1993 | Japan . |
| 1271919 | 11/1986 | U.S.S.R. . |

*Primary Examiner*—Douglas J. McGinty
*Attorney, Agent, or Firm*—Henry D. Coleman; R. Neil Sudol

[57] ABSTRACT

The present invention relates to compositions and methods of removal of contaminants from textiles and related fabrics and garments utilizing compositions which pose no significant risk to groundwater and which are substantially biodegradable. Compositions according to the present invention are substantially non-toxic, substantially bio-degradable liquids at room temperature or higher and are effective in removing substantial quantities of contaminants from fabrics, especially including garments. The present compositions contain at least one dibasic ester, an alcohol, water and at least one surfactant.

31 Claims, No Drawings

COMPOSITION FOR CLEANING TEXTILES

FIELD OF THE INVENTION

The present invention relates to compositions and methods for removing stains, fatty acids, and soil, among other contaminants, from textiles, fabrics and garments normally encountered in the dry cleaning industry.

BACKGROUND OF THE INVENTION

Garments and other fabrics, including carpeting, curtains, etc. become soiled with stains, fatty acids and other contaminants which attach to dust attracted to the garment during the normal course of wear.

Dry cleaning is a growing and flourishing industry worldwide, due to a number of factors. One of these is the increasing desire for cleanliness and increased hygiene. One decisive advantage in dry cleaning processes is its fiber-preserving and shape-retaining properties, in contrast to laundering, which because of the use of water, swells and deforms the shape of many fibers used in fabrics. Another advantage is its ability to concentrate the contaminants into a small volume compared to laundering which produces a large quantity of dirty water. Dry cleaning also has important economic advantages.

The special character of dry cleaning lies in the use of organic solvents as cleaning media. The use of these solvents produces greater efficiency in the removal of many of the contaminants from treated clothing. In laundering, for example, a large part of the dirt and soil is emulsified or suspended, whereas in dry cleaning, the process results in the direct removal of soil. Dry cleaning is therefore much faster than standard laundering processes.

The most frequently used solvent in the world for textile cleaning (dry cleaning) today is perchlorethylene. White mineral spirits and trichloroethylene, formerly of great significance, have, with the exception of China and Japan, have now virtually disappeared. In recent years two fluorocarbons, R113 and R11 entered the market for use as solvent cleaners; however, their use has been limited and is expected to end because of the Montreal Protocol, restricting and ultimately banning production of chlorofluorocarbons (CFC's), beginning in 1996.

The attendant deleterious safety and/or environmental effects of presently used dry cleaning solvents create makes them far from ideal candidates for use as cleaning solvents. Organohalogens in general are environmentally suspect, but perchlorethylene use presents an additional set of concerns because of its high specific gravity of 1.626 (density 13.49 lbs/gal) and its high vapor pressure. Because the density of perchlorethylene is far greater than that of water (8.33 lbs/gal)—and because it is clearly not biodegradable, perchlorethylene spillage presents a threat to groundwater with effects lasting many years. More-over, in many instances in mixed use buildings, air emission guidelines are not met, even with new dry cleaning equipment. The recent problems documented in New York State show that the use of perchlorethylene is of ongoing concern.

White or mineral spirits, which are presently used in Japan and China, as well as other petroleum based solvents present a hazard and exhibit a proclivity to catch fire or even explode in dry cleaning equipment. This is a too-frequent occurrence in Japan where these solvents are in heavy use.

Typical prior art semi-aqueous washing processes generally employ two steps. The first step is a water-immiscible solvent wash step followed by a second step aqueous rinse.

The second step is generally required because the solvents used in this process, unlike perchlorethylene or the CFC's, generally are not volatile and will not evaporate.

OBJECTS OF THE PRESENT INVENTION

It is an object of the present invention to provide compositions for cleaning textiles in clothing and related articles.

It is an additional object of the present invention to provide compositions which are substantially biodegradable and are effective substitutes for cleaning solvents which presently find use in cleaning processes and for use as degreasers for machinery.

It is a further object of the present invention to provide compositions which may be used in present dry cleaning equipment without substantial modification.

It is another object of the present invention to provide methods for cleaning textiles in garments and related articles which make use of the present compositions.

These and other objects of the invention may be readily gleaned from the description of the present invention which follows.

SUMMARY OF THE INVENTION

The present invention relates to compositions and methods of removal of contaminants from textiles and related fabrics and garments utilizing compositions which pose no significant risk to groundwater and which are substantially biodegradable. Compositions according to the present invention preferably are substantially non-toxic, substantially bio-degradable liquids at room temperature or higher and are effective in removing substantial quantities of contaminants from fabrics, especially including garments.

Compositions according to the present invention avoid the use of perchlorethylene, mineral spirits or chlorinated fluorinated hydrocarbons (CFC's). The present compositions may be utilized as effective substitutes for perchlorethylene or mineral spirits in dry cleaning machines and preferably have many of the same physical/chemical characteristics of perchlorethylene with the exception that the present compositions are substantially environmentally compatible and are preferably non-toxic (i.e., these compositions exhibit substantially reduced toxicity compared to the prior art compositions).

The operating parameters currently in use in dry cleaning machines, and in particular, the drying times, drying temperatures and distillation temperatures will preferably be utilized with the present compositions. Some minor modification of dry cleaning machines currently in use (such as the position of the water separator to allow solvent to be removed) may be desirable in order to accommodate the difference in density of the present compositions relative to that of perchlorethylene.

The present compositions have many of the favorable physical and chemical characteristics of perchlorethylene without the attendant unfavorable characteristics, most notably, the environmental incompatibility of perchlorethylene. Compositions according to the present invention preferably will evaporate (in a drying step) rapidly at a temperature of less than about 80° C., more preferably at a temperature of less than about 65° C. (usually, about 50° C. to about 65° C.) and most preferably at a temperature of less than about 60° C. or less (below about 55° C.). Preferably, the compositions distill at a temperature of less than about 150° C., more preferably at a temperature less than about 135° C. The distillation temperature is the temperature of the vapor at the still head, which temperature is generally significantly lower than the pot temperature. It is noted that the composition will preferably provide at least about 90% recovery after distillation.

The present compositions preferably are compatible for use with present dry cleaning equipment and are also capable of being distilled and regenerated after a cleaning operation. The present compositions may accommodate surfactants which may aid the removal of fatty acids, stains and other contaminants from fabrics, especially clothing. In addition, the present compositions are compatible with most, if not all, of the commercial fibers usingn in fabrics. Like perchlorethylene, the present compositions do not substantially change the shape or deform the underlying fibers of the cloth. The present compositions preferably separate from water after a certain weight ratio of water in the composition is reached. The present compositions are preferably distillable at a temperature of less than about 150° C. Despite their relatively low distillation temperatures, the compositions preferably exhibit relatively high open cup flash points (preferably, at least about 125° F., more preferably at least about 150° F.). Compositions according to the present invention are also generally substantially stable during cleaning operations and at drying and distillation temperatures.

Compositions according to the present invention have densities which are generally less than that of water and are preferably biodegradable, preferably with BOD's of greater than about 40 ppm, more preferably about 46 ppm (River Die-Away), even more preferably greater than about 50 ppm. The present compositions are particulary environmentallly advantageous because they are readily biodegradable and they are lighter than water. As such, the present preferred compositions pose little, if any risk to contaminate groundwater. In addition, the present compositions are generally significantly less toxic than is perchlorethylene.

The present invention also relates to a method for cleaning contaminants from textile materials, such as fabric in clothes. In the method aspect of the present invention, the invention preferably employs a one step semi-aqueous process. In the present method, contaminated fabric is exposed to at least one cycle of one or more of the present compositions for a time effective to substantially clean or remove contaminants from the fabric, before the cleaning composition is removed from the fabric (generally, in an extraction step by rotating the cleaning cage containing the garments at high speed). In a subsequent drying step, the cleaned fabric is exposed to an elevated temperature to substantially remove any remaining cleaning composition from the fabric obtained after the cleaning step after which time the fabric is subjected to a cooling step ("cool-down") or period. Optional steps in the method include the removal of a soil/contaminant layer from the composition used to clean the contaminated fabric (bottom separation) and/or distilling the contaminated solvent after the fabric is cleaned.

During the cleaning process, the present compositions solubilize the fabric contaminants, especially soil containing fatty acids and food contaminants, and remove them from the fabric in garments to which they attach. When the contaminants, especially fatty acids, are further solubilized in water-insoluble, oil-soluble surfactants, their density increases, preferably causing them to precipitate out and drop to the bottom of the cleaning solution.

Cleaning preferably takes place at ambient temperatures (preferably, room temperature, but cleaning temperatures may be higher or lower than room temperature) for a period of at least about one minute, preferably about two minutes to twenty minutes or longer, most preferably about five to about ten minutes, after which time an extraction step takes place to remove residual solvent by rotating the cleaning cage at high speed (analogous to a spin cycle in a washing machine). After the extraction step, garments usually contain approximately 10–25% (often, closer to about 20%) residual cleaning composition, which may include a substantial portion of water. The remaining composition is removed from the load of clothing by means of a heated air flow or other means of evaporation (generally, at a temperature of less than about 80° C., preferably less than about 65° C., more preferably less than about 60° C., which volatilizes composition remaining in the clothes after the extraction step. During this convection process, the circulated air heats the load and takes vaporized solvent composition to a recovery condenser in the dry cleaning machine. From there the condensate flows to a solvent tank via a water separator.

The present invention preferably also has the advantage of permitting bottom separation of water, dyes, grease, soil and effluent removed from garments, without distillation as frequent as is the current practice in the industry. When distillation is desired, it is performed preferably at a temperature of about 150° C. or less, more preferably at about 125° C. or less (although the temperature of the pot containing solvent to be distilled may be substantially higher). In the present invention, because any residual matter remaining after distillation would not normally contain hazardous materials (no hazardous or chlorinated materials are generally used in the present compositions), it is expected that the still-bottom residue, in most instances, would not involve hazardous waste disposal as is the current requirement for machines using perchlorethylene.

DETAILED DESCRIPTION OF THE INVENTION

The following definitions will be used throughout the specification to define the present invention.

The term "contaminant(s)" shall be used to describe most substances which are not normally found in fabrics in their clean, uncontaminated state and are generally removed from fabrics during cleaning processes. Contaminents include fats, fatty acids, in particular, triglycerides and fatty acids, fat-like substances, salts, food remnants, sweat, blood, stains, soil, oil and grease and numerous other synthetic and natural or biological contaminants which are normally not found in textiles to be cleaned according to the present invention. The most common contaminents which are removed by compositions according to the present invention include triglycerides, fatty acids and related fatty food contaminants. One of ordinary skill will recognize that the instant invention will be effective in removing a wide variety of textile or fabric contaminants; however, in many instances, depending upon the chemical nature of the contaminant, the present compositions may need to be modified within the teachings of the invention in order to maximize removal of a particular contaminant.

The term "textile(s) and "fabric(s)" are used to describe cloth and related material comprised of natural and synthetic fibers which are used to make garments, clothing, carpeting, cloth covering and related cloth-containing items. Textiles which are compatible for use with the present compositions include textiles made from natural and synthetic fibers and yarns, such as, for example, silks, cottons, wool, leather, fur, alpaca, llama, camel, cashmere, angora, vicuna, guanaco, other animal hair, kapok, linen, hemp, jute, manila, alfa, coconut, broom, kenaf, ramie, sisal, polyesters, acetates, triacetates, rayon, rayon-acetates, cellulose, polypropylene-cellulose, alginates, cupro (regenerated cellulose), modal, regenerated protein fiber, polyacryl, polychloride, fluorofiber, modacryl, polyacrylonitrile, polyamide (including nylon), polyethylene, polypropylene, polyurea, polyurethane, vinylal, trivinyl, elastodiens, elasthane, and mixtures of these natural and synthetic fibers, among others.

The term "dibasic ester(s)" is used in its normal definition to describe typical dialkyl esters of dicarboxylic acids (dibasic acids) capable of undergoing reactions of the ester group, including hydrolysis and saponification. Dibasic esters conventionally at low and high pH can be hydrolyzed to their corresponding dibasic acids and alcohols. Preferred dibasic ester solvents for use in the present invention include dimethyladipate, dimethyl glutarate, dimethyl succinate and mixtures, thereof. Other esters containing longer chain alkyl groups derived from alcohols, for example, ethyl, propyl, isopropyl, butyl, isobutyl, tert. butyl, amyl, isoamyl and mixtures, are also contemplated. The acid portion of the dibasic ester may be derived from such dibasic acids as oxalic, malonic pimelic, suberic and azelaic acids and mixtures thereof, including the preferred dibasic esters.

Dibasic esters are commercially available from sources such as E.I.duPont de Nemours & Co., Inc., Wilmington, Del. under the tradenames DBE. DBE-2, DBE-3, DBE-4, DBE-5, DBE-6 and DBE-9 or Monsanto Company, St. Louis, Mo. under the tradenames Santosol™ DME, DME-2, DME-3, DMG, DMA and DMS. These preferred dibasic ester compositions generally are mixtures of dimethyl adipate, dimethyl glutarate, and dimethyl succinate in varying weight ratios, with the compositions including minor amounts (generally less than 0.5% by weight) of methanol and water. DBE-3, DBE-4 and DBE-5 are more preferred mixtures of the dibasic esters for use in the present invention. DBE-3 is a mixture containing approximately 85–95% by weight dimethyl adipate, 5–15% by weight dimethyl glutarate and no more than about 1% by weight dimethyl succinate. DBE-4 is a mixture containing no more than about 0.1% dimethyl adipate, no more than about 0.4% dimethyl glutarate and at least about 98% by weight dimethyl succinate. DBE-5 is a mixture containing at least about 0.2% dimethyl adipate, at least about 98% dimethyl glutarate and a maximum of about 1% dimethyl succinate.

The dibasic esters are included in the present compositions for their ability to solubilize fats, fatty acids and other hydrophobic contaminants which are to be removed from contaminated garments. The amount of dibasic ester which is included in the present compositions is that amount effective to substantially solubilize hydrophobic contaminants in the fabrics. In general, the amount of a dibasic ester included in the present compositions ranges from at least about 2% by weight, generally about 3% to about 95% by weight, preferably about 5% to about 50%, more preferably about 7.5% to about 35%, most preferably about 10% to about 20% by weight. In certain compositions which are used to clean garments such as gloves which are heavily laden with grease and soot, a higher concentration of dibasic ester ranging from about 20% to about 40% by weight of the composition may be preferred in order to instill the composition with a greater degree of hydrophobicity. The amount of dibasic ester contained in the compositions according to the present invention may need to be reduced in certain instances where the cleaning composition is seen to be a bit too aggressive.

In preferred compositions according to the present invention, a mixture of DBE-3 (primarily dimethyl adipate) and DBE4 (primarily dimethyl succinate) is used. In these preferred compositions, the ratio of dimethyl succinate to dimethyl adipate preferably ranges from about 10:1 to about 1:5, more preferably about 8:1 to about 1:2, even more preferably about 6.0:1 to about 1:1 and most preferably about 3:1 to about 1.5:1. In compositions where the cleaning is desired to be more aggressive (to remove especially hydrophobic stains, such as oils and grease), the ratio of the dibasic esters used may fall outside of the above-described ranges. The above-described ratios are preferred because they provide the dibasic esters in a mixture which is favorable for cleaning hydrophobic contaminants and is consistent with obtaining acceptable recoveries of cleaning composition upon distillation in standard dry cleaning machinery. One of ordinary skill in the art may readily adjust the amount and type of dibasic ester within the present compositions in order to facilitate the cleaning of a broad variety of contaminants from virtually any textile material and to enhance recovery of the cleaning composition(s) after a cleaning step.

The term "alcohol" shall be used throughout the specification to describe a hydrophilic alcohol such as methanol, ethanol, isopropanol, propanol, n-butanol and mixtures thereof, including related or equivalent alcohols which are added to the cleaning compositions to promote the distillation of the composition, to compatibilize the individual components of the composition, to enhance the likelihood of forming azeotropes with other cosolvents (especially water) and to solubilize more hydrophilic contaminants which may appear on the garments to be cleaned. The use of methanol, ethanol, isopropanol and mixtures of these alcohols are clearly preferred, with ethanol and isopropanol more preferred and ethanol most preferred. The alcohol to be included in the compositions according to the present invention ranges from about 5% to about 50% by weight, more preferably about 10% to about 45% by weight, even more preferably about 15% to about 40% by weight and most preferably about 20% to about 30% by weight.

In addition to the inclusion of a hydrophilic alcohol as described above, compositions according to the present invention may also include a hydrophobic alcohol or phenyl-substituted benzyl alcohol. The term "phenyl-substituted benzyl alcohol" is used to describe a benzylic alcohol according to the general structure:

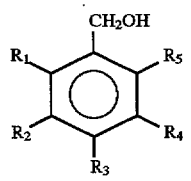

where $R_1$–$R_5$ are H or $C_1$–$C_5$ alkyl. Preferred alcohols include benzyl alcohol and mono-substituted alkyl substituted benzyl alcohols where $R_1$, $R_2$, $R_3$, $R_4$ or $R_5$ are H or $C_1$–$C_3$ alkyl according to the general formula above. Benzyl alcohol is most preferred.

In the present invention, the use of benzyl alcohol or an alkyl-substituted benzyl alcohol (most preferably, $C_1$–$C_3$ alkyl substituted at the 2, 4 or 6 position of the phenyl ring) is preferred, with benzyl alcohol being especially preferred.

Phenyl-substituted benzyl alcohols (which term includes benzyl alcohol) are added to the present compounds in order to boost the hydrophobicity of the present compositions as well as enhance the distillation of the present composition after it is used to clean textiles and becomes contaminated.

Phenyl-substituted benzyl alcohols generally comprise about 0% to about 10% by weight of the present compounds, more preferably about 0% to about 5% by weight, even more preferably about 0% to about 2% by weight and most preferably about 0.05% to about 0.5% by weight. Benzyl alcohol is the preferred phenyl-substituted benzyl alcohol for use in the present invention.

Terpene compounds may also be included in the present cleaning compositions, primarily to boost the hydrophobic character of the compositions. As used herein, the term "terpene compound" refers to a class of acyclic and cyclic unsaturated compounds derived from natural essential oils and resins having at least 10 carbon atoms. Terpenes that find use in the present invention include alcohols and aldehydes as well as unsaturated hydrocarbons. Any number of terpene compounds, including combinations of these terpenes may be used in the present invention as optional compounds to promote or increase the hydrophobic character of the cleaning compositions according to the present invention.

Preferred terpene compounds for use in the present invention are represented by unsaturated hydrocarbons, alcohols and aldehydes having at least 10 carbon atoms and include alpha-terpinene, alpha-pinene, beta-pinene, delta-3-carene, citronellal, citronellol, hydroxycitronellal, d-limonene, linalool, gamma-terpinene, tetrahydrolinalool and terpineol, among others. Especially preferred terpenes for use in compositions of the present invention include alpha-terpinene and terpineol. A preferred terpineol for use in the present invention is Glidsol 175™ from Glidco (Jacksonville, Florida) because of its highly hydrophobic character.

Compositions of the present invention comprise about 0% to about 20% by weight of a terpene compound, more preferably about 0% to about 15%, and even more preferably about 0% to about 6% by weight. The terpene compounds of the present invention are used in the above-defined weight ranges because these weight ranges are effective to increase the hydrophobic character of the compositions where applicable, and in certain applications, advantageously help to decrease the distillation temperature of the compositions by helping to promote azeotrope formation.

The compositions according to the present invention also contain at least one surfactant. Surfactants are included in compositions according to the present invention for their ability to solubilize and/or emulsify contaminants to be removed from the textiles to be cleaned, to compatibilize hydrophilic and hydrophobic components of the present compositions, especially water and the dibasic esters, and/or in certain instances, for their ability to eliminate water as a separate phase of the composition once a threshhold amount of water is reached in a composition. The ability of the surfactant to aid the composition to eliminate water is a particularly advantageous aspect of the compositions according to the present invention inasmuch as cleaning compositions may tend to increase their aqueous content after each cleaning operation and after exposure to humid ambient conditions. The use of an appropriate surfact mixture may aid the separation of excess or undesired quantities of water from the present compositions after a cleaning step or after storage.

Surfactants are also included in compositions of the present invention. These may be anionic, cationic or nonionic surfactants. Generally, one or more surfactants are included in the present compositions in an amount effective to emulsify and compatibilize the components of the composition, generally about 0.001% to about 15% or more by weight, preferably about 0.2% to about 10% by weight, more preferably about 0.5% to about 5% and most preferably about 1.0% to about 3% by weight. Numerous surfactants may be employed in compositions according to the present invention, including, but not limited, to linear or branched chain alcoholic ethoxylates and ethoxysulfates, alcohol ethoxylates, polysorbate esters, ethoxylated alkylphenols, for example, polyethoxynonylphenols, phenoxypolyalkoxyalcohols, for example, nonylphenoxypoly(ethyleneoxy)ethanol and nonylphenoxypolyethoxyethanol, alkyl and alkyl ether sulfates and sulfonates, for example, dodecylbenzenesulfonic acid, alkyl and dialkyl succinate compounds, phosphate esters, for example phosphate esters of long-chain alcohol ethoxylates and combinations of these surfactants.

Other surfactants for use in compositions of the present invention include the phosphate ester surfactants, for example PD-600™, an alkaline stable mixture of mono and di-substituted phosphate esters of decylalcoholethoxylate, available from Chemax, Inc. (Greenville, S.C.) and the Tryfac™ phosphate esters, a series of phosphate ester surfactants as the free acids or various salts, available from Emery Chemicals, Mauldin, S.C. Alkylamine dodecylbenzenesulfonate, Ninate 411™, available from Stepan Company, as well as the substituted benzene sulfonate surfactants such as Bio-soft N-300™ and Biosoft N-411™, also available from Stepan, among others, may also be used in the present invention. Preferred surfactants include polyoxyethylenenonylphenol (NP-6™ and NP-9™), available from Chemax, Inc., Greenville, S.C.) as well as the nonionic alkylphenoxypolyoxyethylene alcohols, the Makon™ series, available from Stepan Company, Northfield, Ill.

Particularly preferred surfactants include the nonyl phenolethoxylate surfactants, which are obtained from the reaction product of ethylene oxide and nonylphenol. The number of moles of ethylene oxide reacted with nonylphenol determine the length of the polyethyleneoxide side chain, the hydrophilicity of the polyethyleneoxide side chain (the longer the chain, the more hydrophilic) and the overall hydrophilicity or hydrophobicity of the final surfactant compound used.

Although as indicated above, anionic, nonionic and cationic surfactants may be employed for use in the present invention, it is preferable to employ nonionic surfactants and in particular, the alkylphenolethoxylate surfactants, more preferably, the nonylphenolethyoxylate surfactants. Preferred alkylphenolethoxylate surfactants for use in the present invention include those surfactants having a hydrophile-lipophile balance (HLB) value of between about 8 and 12, preferably about 9 to 12, more preferably about 10 to 11 or 11.5 and most preferably about 11. Nonylphenolethoxylate surfactants are especially preferred for use in the present invention, including for example, nonylphenolethoxylate surfactants which are sold under the tradenames Makon 4, Makon 6, Makon 8, Makon 10 and Makon 12, available from Stepan Company, Northfield, Ill., as well as the preferred nonylphenolethoxylate surfactants Surfonic N-60 and N-100, also commonly known as Poly(Oxy-1,2-ethanediyl), Alpha-(Nonylphenyl)-Omega-Hydroxy-, or Alpha-(Nonylphenyl)-Omega-Hydroxy-Poly(Oxy-1,2-ethanediyl). Surfonic N-60, Makon 6 and mixtures thereof, are especially preferred because these surfactants have HLB values at or about 11 (an HLB value which indicates that the surfactant is neither water soluble nor oil soluble). Mixtures of these and other surfactants are also contemplated for use in the present compositions.

The selection of a surfactant system for the present compositions is important to produce emulsified compositions which have compatibilized the disparite chemical components into a relatively uniform mixture. The surfactant system also influences the ability of the final compositions to expunge water after a certain level of water is reached. Different solvent systems dispersion requires different types and levels of surfactants. Combinations of non-ionic and anionic surfactants are generally more effective in some systems than either used alone, as is clearly indicated in the examples section which follows. Because only a given amount of anionic surfactant could be adsorbed into some systems to provide the desired results, further adsorption was precluded. Nonionic surfactants bearing no electric charge were added to provide additional stability. In other systems, the use of one or more nonionic surfactant, especially a nonylphenolethoxylate surfactant was preferred.

As indicated above, the hydrophile-lipophile balance (HLB) of a particular surfactant is perhaps the best way of providing guidance to the applicability of a given surfactant for use in compositions according to the present invention. Some simplification in the selection process for surfactant systems may be achieved by using the HLB of a given surfactant or group of surfactants to guide the successful introduction of surfactants in to compositions according to the present invention. The HLB system was developed in the 1950's; in this system, each surfactant is assigned a number which reflects the relative size and influence of a hydrophilic portion of a surfactant in relation to its hydrophobic portion. Using this system for example, in nonionic surfactants, the HLB number is related to the percent by weight of the hydrophilic portion, with a completely hydrophilic material being assessed a value of 20 and a completely lipophilic (hydrophobic) material being assessed a value of 0. A surfactant with an HLB value of approximately 10 has an equal balance of hydrophilic and lipophilic groups and is generally not considered either water soluble or fat/oil soluble.

Each portion of the surfactant molecule contributes to the overall HLB of the surfactant, and each molecular group has been assessed a number that may be used to calculate this overall effect on the total HLB value. Typical values for exemplary molecular segments are listed below.

| Hydrophilic Groups | |
|---|---|
| Group | H Number |
| NaSO— | 39.0 |
| KOOC— | 21.0 |
| NaOOC— | 19.0 |
| HOOC— | 2.1 |
| HO— | 1.9 |
| —O— | 1.3 |
| —($CH_2CH_2O$) | 0.36 |
| **Lipophilic Groups** | |
| Group | L Number |
| —CH— | 0.47 |
| —$CH_2$— | 0.47 |
| —$CH_3$ | 0.47 |
| =CH | 0.47 |
| —($CH_2C(CH_3)HO$)— | 0.11 |

In determining the HLB of a given molecule, HLB is calculated from the sum of the hydrophilic group values minus the sum of the lipophilic group values according to the formula:

$$HLB=7+\Sigma_H-\Sigma_L$$

See generally, *PROTECTIVE COATINGS, Fundamentals of Coatings and Compositions* by Clive H. Hare, Copyright 1994, by Technology Publishing Company, USA.

Thus, the HLB value may be useful generally to provide guidance to the introduction of surfactants in the present compositions. As indicated above, the HLB value of surfactants in preferred compositions according to the present invention preferably ranges from about 8 to about 12, with a more preferred range of about 9 to 12, an even more preferred range about 10 to about 11 or 11.5 and a most preferred value of about 11.

It is noted that the above-described preferred HLB values are provided merely as guidance for using the more preferred surfactants which are included in the present compositions. In instances where the overall nature of the compositions change, e.g., where they become more hydrophilic or more hydrophobic in character for a particular application, the HLB values of preferred surfactants may fall outside of the above-described ranges. One of ordinary skill in the art may readily change and adjust the HLB value of the surfactant system used depending upon the desired result. For example, more hydrophobic compositions may require more or less hydrophobic surfactants for providing desired characteristics (HLB less than 10). In the case of more hydrophilic compositions, the desired characteristics may require a more hydrophilic surfactant (HLB greater than 10). Combinations of hydrophobic and hydrophilic solvents to produce compositions having vastly different physical characteristics may require surfactants with HLB values above and below these previously described ranges.

The pH of the cleaning compositions of the present invention may vary from somewhat acidic to somewhat alkaline within the range of about 3.5 to about 9.0. Preferred compositions generally have a substantially neutral pH in order to reduce the effect the compositions have on the textiles to be cleaned and the machine used to clean the garments. A pH of about 6.0 to about 8.0 is preferred, more preferably about 7.0. In producing the compositions of the present invention, there may be a desire to neutralize the compositions after formulation for maintaining stability. In the case of a basic composition, this may be done by adding an organic acid such as acetic acid or related organic acids. In the case of an acidic composition, this may be substantially neutralized with a biodegradable amine-containing compound such as aminomethylpropanol, triethylamine, triethanolamine or a related amine or biodegradable basic composition. The neutralization of acidic compositions with aminomethylpropanol is preferred.

Compositions according to the present invention also include water in amounts generally ranging from about 3% to about 75% by weight (preferably at least about 5% within this range), preferably about 10% to about 70% by weight, more preferably about 20% to about 65% by weight, even more preferably about 30% to about 60% by weight and most preferably about 45% to about 60% by weight. Water is included within the compositions according to the present invention for its benefit in solubilizing water-soluble stains and other textile contaminants such as certain foods, blood, other biological fluids, etc., as well as its relatively low distillation temperature (100° C.) which provides the benefit of aiding in azeotrope formation or in helping to distill some of the less volatile components in the present compositions. In addition, water is generally one of the least expensive components used in the present invention, thus making compositions more cost effective and economically viable as more water is used.

In producing the present compositions, the individual components may be added in any order and stirred to provide a completely mixed product. In most instances the product is clear at room temperature. In certain instances, the product may be hazy to slightly hazy at room temperature, but may become clear after the temperature is raised somewhat above room temperature.

Certain compositions according to the present invention may also include triethanolamine as a cosolvent in amounts ranging from about 0.1% to about 10% by weight, more preferably about 0.1% to about 5% by weight.

The present compositions may be used as cleaning compositions, for example, in standard dry cleaning methods for cleaning clothes and other textile materials including carpeting and related materials, as spot removers before a cleaning operation is carried out on clothing, carpeting and related materials, as oil and grease removers (hydrophobic composition removers) or degreasers either in clothing or on machinery and tools and general cleaners. Other applications readily apparent to one of ordinary skill in the art are also contemplated for use with the present compositions.

Certain compositions according to the present invention find particularly favorable use as suitable replacements for per-chlorethylene, mineral spirits, CFC's and other somewhat toxic and non-biodegradable solvents which are traditionally used in dry cleaning operations. Preferred compositions according to the present invention may be used in standard dry cleaning equipment, for example, equipment supplied by Böwe Machinenfabrik GMBH, Augsburg, Germany, Multi-Matic Corp., Montvale, N.J. and Grace Equipment Corp., Woodbury, N.Y., among others.

In a cleaning method according to the present invention, clothing or other textile-containing materials are exposed to one or more of the composition according to the present invention for a time sufficient for cleaning or removing at least a substantial portion of the contaminent(s) in the clothing or other material to be cleaned. In traditional dry cleaning machines and methods, garments to be cleaned are preferably exposed to the cleaning composition for a period of at least about one minute, preferably about two minutes to twenty minutes or longer, most preferably about five to about ten minutes. After a first wash step where the garments are exposed to the present cleaning compositions as described above, one or more additional washing steps also may be used for the same or longer period of time, depending upon the amount or degree of soil or contamination in the clothing to be cleaned. Preferably, only one wash step is used, however. Preferred compositions are used at room temperatures or higher, i.e., at temperatures preferably above about 20° C., more preferably above about 23° C. in order to insure a homogeneous composition.

After one or more washing steps, the contaminated composition is generally removed from the cleaned garments in an extraction step conducted by rotating the cleaning cage containing containing the clothing at high speed (analogous to a spin cycle in a washing machine). Thereafter, whatever cleaning solvent remains in the cleaned garments is dried or evaporated in a drying step within the cage of the dry cleaning machine, preferably at a temperature of less than about 80° C., more preferably at a temperature of less than about 65° C. (usually, about 50° C. to about 65° C.) and most preferably at a temperature of less than about 60° C. or even less (below about 55° C.). After the drying step, which occurs at elevated temperature, the garments are exposed to a cooling or "cool down" step to bring the clothes down to a temperature which approaches room temperature. The clothes may be removed from the machines at this point.

The contaminated cleaning solvent may be regenerated in one or more ways. In a first method, contaminants which have been removed from the garments may appear in the solvent trap of the dry cleaning machine as a mixture of layers, at least one of which is a clear layer and at least one of which is a dirty, contaminated layer. In certain applications, it is possible to merely separate off the bottom contaminated layer from the remaining uncontaminated cleaning solvent without any further preparation or distillation. In other embodiments, the compositions are cleaned up by subjecting contaminated solvent to a distillation step in the dry cleaning equipment as is standard procedure in many dry cleaning operations today. Preferably, the compositions distill (preferably with at least about 90% or more by weight recovery) at a temperature of less than about 150° C., more preferably at a temperature of about 135° C. or less.

After the above-described separation or distillation step, the composition may contain an enrichment of components which is not ideal for further cleaning. In many instances, after separation or distillation, the cleaning compositions will have to be reconstituted or regenerated with surfactant and/or higher boiling cosolvents, which separated out from the compositions or did not distill with the other components of the composition. Therefore, the present invention also contemplates the reconstitution or regeneration of the cleaning compositions according to the present invention after a separation or distillation step comprising adding to the separated or distilled composition a reconstitution composition comprising at least one dibasic ester as described hereinabove in an amount ranging from about 5% to about 94.5% by weight, preferably about 10% to about 80% by weight, more preferably about 15% to about 50% by weight of the reconstitution compostion, at least one hydrophilic alcohol as described hereinabove, preferably an alcohol selected from the group consisting of methanol, ethanol, isopropanol and mixtures, thereof in an amount ranging from about 5% to about 60%, preferably about 5% to about 40%, more preferably about 10% to about 30% by weight and at least one surfactant ranging from about 0.5% to about 85%, preferably about 5% to about 65% and more preferably about 15% to about 50% by weight of the reconstitution composition. In addition, water may be added to the reconstitution composition in an amount of at least 2% to about 50% by weight, more preferably about 3% to about 20% by weight and more preferably about 5% to about 15% by weight water. Other components such as terpenes, benzyl alcohol (in amounts generally less than about 15% by weight of the reconstitution composition and preferably less than about 5% by weight of the reconstition composition), among other components, may also be included in the reconstitution composition. By adding the reconstitution composition to the distilled or separated cleaning composition, the cleaning composition may be regenerated to a composition identical to or closely resembling the original cleaning composition.

The following examples are provided to illustrate the present invention and should not be misunderstood to limit the scope of the present invention in any way.

EXAMPLES

The task was to prepare compositions which emulate the performance characteristics of perchlorethylene. The compositions should have a sufficient $K_B$ value to enable it to solubilize fats and fatty acids, be sufficiently hydrophobic to reject and separate excess water, have a sufficiently high flash point to render it operationally harmless from ignition or explosion, have a relatively neutral pH, remain stable after repeated distillation cycles, be biodegradable and relatively non-toxic, be sufficiently volatile to vaporize at 50°–60° C. to permit machine drying in twenty minutes and be compatible with all classifications of garment fabrics and materials, including acetates and rayon acetates, normally encountered in the industry.

In dry cleaning, distillation is conducted at approximately every fifth load at temperatures preferably not exceeding 150° C. Perchlorethylene distills between about 120° C. and 130° C. Equipment constraints established by the steam pressure generated establish maximum temperatures attainable. Those limits generally are 80 PSI to 100 PSI, with 80 PSI preferable:

PSI=14.50×(no. of Bar)

i.e., 14.50×5.5 bar=79.75 PSI 14.50×6.9 bar=100 PSI

Since saturated and supersaturated steam at 79.53 PSI has a temperature of 312° F. (155.5° C.), roughly the 5.5 bar capability of the installed base of dry cleaning equipment, these conditions established the parameters of laboratory distillation of the exemplary compositions. The equipment used for distillation was a 500 ml flask equipped with a solvent recovery condensor attached to a distilling head and connected to 250 ml volumetric flask to collect distillate.

The following compositions were made and assessed for their ability to clean typical contaminants from textiles, to be distilled after a cleaning operation (assessed for distillation temperature and for recovery of distillate) and for their solvent effect on typical textiles and fabrics (silks and cottons and in particular, rayon acetates). In addition, the compositions were generally assessed for their ability to expunge (separate from) excess water and to dry after a cleaning step at temperatures compatible with the stability of the underlying textiles and for their ability to separate from fatty acids, fat contaminants, oil, grease and other contaminants in one or more distinct, separate layer(s). Finally, the compositions were assessed for their tendency to shrink different materials, including silks, cottons, leather and synthetics at temperatures which are generally used in a typical drying or evaporation step.

In determining the effect of the cleaning composition on individual textiles, a range of garments made from 30 different textiles were measured for shrinkage by certain of the dry cleaning compositions. The following textiles, among others, were tested: 100% wool, 100% silk, 100% rayon, 100% polyester, 100% acetate, 100% acrylic, leather, 100% cotton, 100% combed cotton, blends of the above textiles, 50% Ramie/45% cotton, 50% lamb's wool/40% Angora/10% nylon and blends of dacron/polyester as well as blends of the other fabrics. In order to determine shrinkage the individual garments were measured as a whole and in 2 inch squares before and after exposing the garments to the cleaning composition for a period of between 1 and 5 minutes (edge testing). In a number of instances, the compositions were too aggressive to rayon acetate textiles and the amount of DBE was reduced. Thereafter, in certain instances, the garments were exposed to a full cleaning run in dry cleaning equipment using a 3 minute wash, a 4.5 minute extraction cycle and an 18 minute drying cycle.

The compositions of examples 20 and 103 were used as cleaning compositions in test runs in Multi-Matic™ (Northvale, N.J.) Dry-To-Dry 25 Pound Capacity Dry Cleaning Machines, with minor modification (to raise temperature- heating unit or electric boiler was modified).

The following components were used in the following examples to produce compositions exemplary of the present invention. Alpha-terpinene (purity of 75%) and Glidsol 175 (high $K^B$ terpineol), two terpene compounds, were obtained from Glidco, Co. Dibasic esters (DBE-3, DBE-4, and DBE-5) were obtained from E.I. DuPont de Nemours & Company, Wilmington, Del. Ethanol was used as 95% ethanol (190 proof). 95% ethanol (190 proof) and methanol may be obtained from any of a large number of suppliers, including Ashland Chemical Co. Benzyl alcohol was obtained from DSM Special Products, Inc. AMP 95 was obtained from Ashland Chemicals, Northbrook, Ill. Triethanolamine was obtained from Dow Chemical Co., Midland, Michigan. PD-600, a phosphate surfactant, was obtained from Chemax, Inc., Greenville, S.C. Staticol, another surfactant was obtained from R. R. Streets and Co., Nappaville, Ill. FC-171, FC-129 and FC-430 are fluorocarbon surfactants available from 3M, Minneapolis, Minn. The Biosoft surfactants (N-300 and N-411) are benzenesulfonate surfactants available from Stepan Company, Northfield, Ill. Polystep B-7 is a surfactant available from Stepan Company. The Makon surfactants (Makon 4, 6, 8 and 10 and NF-5 and NF-12) are available from Stepan Company. Surfonic N-60, N-85 and N-100 are nonylphenol ethoxylate surfactants available from Huntsman Chemical Co., Houston, Tex. COVI-OX T-70 is a mixture of tocopherol antioxidant additives available from Henkel Corporation, La Grange, Ill.

In producing the compositions, the individual components may be added in any order and stirred to provide a completely mixed product. In the following examples, for the most part, the components were added in the order in which they appear. Water was generally added last in order to determine the amount of water which was compatible with the other components. In most instances the product was clear at room temperature. In certain instances, the product was hazy to slightly hazy at room temperature, but generally became clear after the temperature was raised somewhat above room temperature.

| COMPONENT | WEIGHT PERCENT |
|---|---|
| EXAMPLE 1 | |
| ALPHA-TERPINENE (75%) | 5.3 |
| DBE-3 | 66.0 |
| DBE-5 | 25.0 |
| PD-600 | 0.2 |
| STATICOL | 0.5 |
| WATER | 3.0 |
| EXAMPLE 2 | |
| ALPHA-TERPINENE (75%) | 5.3 |
| DBE-3 | 66.0 |
| DBE-5 | 25.5 |
| PD-600 | 0.2 |
| WATER | 3.0 |
| EXAMPLE 3 | |
| ALPHA-TERPINENE (75%) | 5.3 |
| DBE-3 | 65.3 |
| DBE-5 | 26.0 |
| PD-600 | 0.1 |
| ETHANOL | 1.0 |
| STATICOL | 0.8 |
| WATER | 1.5 |
| EXAMPLE 4 | |
| ALPHA-TERPINENE (75%) | 5.07 |
| DBE-3 | 65.58 |
| DBE-5 | 26.00 |
| PD-600 | 0.1 |
| ETHANOL | 1.00 |
| STATICOL | 0.75 |
| WATER | 1.50 |
| FC-129 | 0.04 |

-continued

| COMPONENT | WEIGHT PERCENT |
|---|---|
| EXAMPLE 5 | |
| ALPHA-TERPINENE (75%) | 5.07 |
| DBE-3 | 65.58 |
| DBE-5 | 26.00 |
| PD-600 | 0.10 |
| ETHANOL | 1.00 |
| STATICOL | 0.75 |
| WATER | 1.50 |
| FC-171 | 0.04 |
| EXAMPLE 6 | |
| ALPHA-TERPINENE (75%) | 5.07 |
| DBE-3 | 68.89 |
| DBE-5 | 26.00 |
| FC-171 | 0.04 |
| EXAMPLE 7 | |
| ALPHA-TERPINENE (75%) | 5.07 |
| DBE-3 | 68.93 |
| DBE-5 | 26.00 |
| EXAMPLE 8 | |
| DIPENTENE | 5.07 |
| DBE-3 | 68.93 |
| DBE-5 | 26.00 |
| EXAMPLE 9 | |
| ALPHA-TERPINENE (75%) | 8.00 |
| DBE-3 | 66.46 |
| DBE-5 | 25.50 |
| FC-129 | 0.04 |
| EXAMPLE 10 | |
| ALPHA-TERPINENE (75%) | 8.00 |
| DBE-3 | 66.46 |
| DBE-5 | 25.50 |
| FC-171 | 0.04 |
| EXAMPLE 11 | |
| ALPHA-TERPINENE (75%) | 8.00 |
| DBE-3 | 66.46 |
| DBE-5 | 25.50 |
| FC-430 | 0.04 |
| EXAMPLE 12 | |
| ALPHA-TERPINENE (75%) | 8.00 |
| DBE-3 | 66.46 |
| DBE-5 | 25.50 |
| FC-171 | 0.04 |
| EXAMPLE 13 | |
| ALPHA-TERPINENE (75%) | 7.00 |
| GLIDSOL 175 | 1.00 |
| ETHANOL | 4.00 |
| DBE-3 | 63.72 |
| DBE-5 | 24.20 |
| FC-171 | 0.04 |
| COVI-OX T-70 | 0.04 |
| EXAMPLE 14 | |
| ALPHA-TERPINENE (75%) | 9.00 |
| GLIDSOL 175 | 1.00 |
| ETHANOL | 4.00 |
| DBE-3 | 54.90 |
| DBE-5 | 31.00 |
| FC-171 | 0.06 |
| COVI-OX T-70 | 0.04 |
| EXAMPLE 15 | |
| ALPHA-TERPINENE (75%) | 9.00 |
| GLIDSOL 175 | 0.5 |
| ETHANOL | 6.0 |
| DBE-3 | 53.40 |
| DBE-5 | 31.00 |
| FC-171 | 31.06 |
| COVI-OX T-70 | 0.04 |

-continued

| COMPONENT | WEIGHT PERCENT |
|---|---|
| EXAMPLE 16 | |
| ALPHA-TERPINENE (75%) | 15.00 |
| GLIDSOL 175 | 0.04 |
| ETHANOL | 6.00 |
| DBE-3 | 39.00 |
| DBE-5 | 39.92 |
| COvI-OX T-70 | 0.04 |
| EXAMPLE 17 | |
| ALPHA-TERPINENE (75%) | 9.00 |
| GLIDSOL 175 | 0.04 |
| ETHANOL | 6.00 |
| DBE-3 | 45.00 |
| DBE-5 | 39.92 |
| COVI-OX T-70 | 0.04 |
| EXAMPLE 18 | |
| ALPHA-TERPINENE (75%) | 15.00 |
| GLIDSOL 175 | 0.02 |
| ETHANOL | 3.12 |
| DBE-3 | 39.50 |
| DBE-5 | 39.92 |
| COVI-OX T-70 | 2.40 |
| EXAMPLE 19 | |
| ALPHA-TERPINENE (75%) | 14.000 |
| COVI-OX T-70 | 0.040 |
| GLIDSOL 175 | 0.015 |
| ETHANOL | 4.500 |
| DBE-3 | 39.220 |
| DBE-5 | 39.325 |
| WATER | 2.900 |
| EXAMPLE 20 | |
| ALPHA-TERPINENE (75%) | 13.960 |
| COVI-OX T-70 | 0.040 |
| GLIDSOL 175 | 0.015 |
| ETHANOL | 4.500 |
| DBE-3 | 39.220 |
| DBE-5 | 39.325 |
| WATER | 2.900 |
| FC-171 | 0.04 |
| EXAMPLE 21 | |
| ALPHA-TERPINENE (75%) | 13.920 |
| COVI-OX T-70 | 0.040 |
| GLIDSOL 175 | 0.015 |
| ETHANOL | 4.500 |
| DBE-3 | 39.220 |
| DBE-5 | 39.325 |
| WATER | 2.900 |
| FC-171 | 0.08 |
| EXAMPLE 22 | |
| DBE-4 | 0.018 |
| DBE-3 | 13.750 |
| BENZYL ALCOHOL | 0.090 |
| ETHANOL | 27.034 |
| MAKON NF-5 | 2.749 |
| BIOSOFT N-411* | 1.830 |
| WATER | 54.527 |
| EXAMPLE 23 | |
| DBE-4 | 2.76 |
| DBE-3 | 10.00 |
| BENZYL ALCOHOL | 0.23 |
| ETHANOL | 26.70 |
| MAKON NF-5 | 4.30 |
| WATER | 56.01 |
| EXAMPLE 24 | |
| Alpha-Terpinene (75) % | 15.00 |
| COVI-OX T-70 | 0.04 |
| ETHANOL | 3.12 |
| DBE-3 | 39.50 |
| DBE-5 | 39.92 |
| WATER | 2.40 |

-continued

| COMPONENT | WEIGHT PERCENT |
|---|---|
| EXAMPLE 25 | |
| ALPHA-TERPINENE (75%) | 5.07 |
| COVI-OX-T-70 | 0.04 |
| DBE-3 | 5.5 |
| ETHANOL | 3.12 |
| WATER | 3.15 |
| FC-171 | 0.04 |
| EXAMPLE 26 | |
| ALPHA-TERPINENE (75%) | 6.00 |
| COVI-OX-T-70 | 0.07 |
| DBE-3 | 44.35 |
| ETHANOL | 42.92 |
| WATER | 3.12 |
| FC-171 | 0.04 |
| EXAMPLE 27 | |
| ALPHA-TERPINENE (75%) | 6.00 |
| COVI-OX-T-70 | 0.07 |
| DBE-3 | 35.00 |
| DBE-5 | 52.11 |
| ETHANOL | 3.12 |
| WATER | 3.50 |
| FC-171 | 0.04 |
| EXAMPLE 28 | |
| ALPHA-TERPINENE (75%) | 4.00 |
| COVI-OX-T-70 | 0.07 |
| DBE-3 | 33.20 |
| DBE-5 | 52.11 |
| ETHANOL | 5.12 |
| WATER | 5.42 |
| FC-171 | 0.08 |
| EXAMPLE 29 | |
| ALPHA-TERPINENE (75%) | 6.00 |
| COVI-OX-T-70 | 0.07 |
| DBE-5 | 38.30 |
| AMP95 | 0.30 |
| ETHANOL | 32.00 |
| WATER | 22.93 |
| FC-171 | 0.40 |
| EXAMPLE 30 | |
| ALPHA-TERPINENE (75%) | 6.63 |
| COVI-OX-T-70 | 0.07 |
| DBE-5 | 38.30 |
| AMP95 | 0.03 |
| ETHANOL | 32.00 |
| WATER | 22.93 |
| FC-171 | 0.04 |
| EXAMPLE 31 | |
| ALPHA-TERPINENE (75%) | 4.00 |
| COVI-OX-T-70 | 0.07 |
| DBE-3 | 10.31 |
| DBE-5 | 79.00 |
| ETHANOL | 3.12 |
| WATER | 3.50 |
| FC-171 | 0.04 |
| EXAMPLE 32 | |
| DBE-4 | 20.00 |
| ETHANOL | 18.00 |
| GLIDSOL 175 | 7.1 |
| N-85 | 4.90 |
| WATER | 50.00 |
| EXAMPLE 33 | |
| DBE-4 | 21.40 |
| METHANOL | 3.00 |
| ETHANOL | 18.00 |
| GLIDSOL 175 | 1.00 |
| N-60 | 3.00 |
| N-85 | 3.00 |
| TRIETHANOLAMINE99 | 0.50 |
| WATER | 49.00 |

-continued

| COMPONENT | WEIGHT PERCENT |
|---|---|
| EXAMPLE 34 | |
| DBE-4 | 19.00 |
| METHANOL | 2.00 |
| BENZYL ALCOHOL | 7.00 |
| ETHANOL | 14.30 |
| GLIDSOL 175 | 0.70 |
| N-60 | 1.10 |
| N-85 | 1.0 |
| TRIETHANOLAMINE 99 | 7.10 |
| WATER | 49.10 |
| EXAMPLE 35 | |
| DBE-4 | 20.00 |
| ETHANOL | 22.50 |
| GLIDSOL 175 | 0.50 |
| N-60 | 4.70 |
| WATER | 52.30 |
| EXAMPLE 36 | |
| DBE-4 | 19.80 |
| DBE-5 | 3.00 |
| BENZYL ALCOHOL | 2.00 |
| ETHANOL | 23.00 |
| GLIDSOL 175 | 0.50 |
| N-60 | 4.70 |
| WATER | 47.00 |
| EXAMPLE 37 | |
| DBE-4 | 24.90 |
| METHANOL | 3.00 |
| ETHANOL | 13.00 |
| GLIDSOL 175 | 1.00 |
| N-60 | 7.00 |
| N-85 | 3.50 |
| TRIETHANOLAMINE 99 | 0.60 |
| WATER | 47.00 |
| EXAMPLE 38 | |
| DBE-4 | 16.00 |
| BENZYL ALCOHOL | 7.50 |
| ETHANOL | 16.00 |
| GLIDSOL 175 | 0.50 |
| NINATE 411 | 2.00 |
| WATER | 57.97 |
| AMP | 0.03 |
| EXAMPLE 39 | |
| DBE-4 | 14.00 |
| BENZYL ALCOHOL | 5.50 |
| ETHANOL | 17.00 |
| GLIDSOL 175 | 0.25 |
| NINATE 411 | 2.50 |
| WATER | 60.74 |
| AMP | 0.01 |
| EXAMPLE 40 | |
| DBE-4 | 3.00 |
| DBE-3 | 5.00 |
| BENZYL ALCOHOL | 0.25 |
| ETHANOL | 27.95 |
| MAKON NF-5 | 3.80 |
| WATER | 60.00 |
| EXAMPLE 41 | |
| DBE-4 | 5.60 |
| DBE-3 | 18.87 |
| BENZYL ALCOHOL | 0.94 |
| ETHANOL | 27.42 |
| GLIDSOL 175 | 0.24 |
| MAKON NF-12 | 2.83 |
| WATER | 44.10 |
| EXAMPLE 42 | |
| ALPHA-TERPINENE (75%) | 6.36 |
| COVI-OX-T-70 | 0.07 |
| DBE-5 | 38.30 |
| AMP95 | 0.30 |

-continued

| COMPONENT | WEIGHT PERCENT |
|---|---|
| ETHANOL | 32.00 |
| WATER | 22.93 |
| FC-171 | 0.04 |
| **EXAMPLE 43** | |
| DBE-4 | 3.00 |
| DBE-3 | 5.00 |
| BENZYL ALCOHOL | 0.25 |
| ETHANOL | 27.95 |
| GLIDSOL 175 | 0.10 |
| MAKON NF-5 | 3.80 |
| WATER | 59.90 |
| **EXAMPLE 44** | |
| DBE-4 | 2.00 |
| DBE-3 | 12.00 |
| ETHANOL | 21.90 |
| GLIDSOL 175 | 0.10 |
| MAKON NF-5 | 4.00 |
| WATER | 60.00 |
| **EXAMPLE 45** | |
| DBE-4 | 2.00 |
| DBE-3 | 12.00 |
| WATER | 60.00 |
| ETHANOL | 21.40 |
| GLIDSOL 175 | 0.10 |
| POLYSTEP B-7 | 2.00 |
| MAKON NF-5 | 2.50 |
| **EXAMPLE 46** | |
| DBE-4 | 12.00 |
| METHANOL | 56.00 |
| TRIETHANOLAMINE 99 | 5.0 |
| AMP | 0.04 |
| WATER | 15.96 |
| **EXAMPLE 47** | |
| DBE-4 | 2.85 |
| DBE-3 | 14.00 |
| WATER | 60.00 |
| ETHANOL | 23.00 |
| BENZYL ALCOHOL | 0.15 |
| **EXAMPLE 48** | |
| DBE-4 | 19.00 |
| METHANOL | 3.00 |
| ETHANOL | 15.00 |
| GLIDSOL 175 | 1.60 |
| N-60 | 5.40 |
| N-85 | 6.00 |
| TRIETHANOLAMINE 99 | 2.00 |
| WATER | 48.00 |
| **EXAMPLE 49** | |
| ALPHA-TERPINENE (75%) | 5.3 |
| DBE-3 | 65.0 |
| DBE-5 | 25.0 |
| PD-600 | 0.2 |
| STATICOL | 1.5 |
| WATER | 3.0 |
| **EXAMPLE 50** | |
| ALPHA-TERPINENE (75%) | 6.00 |
| COVI-OX T-70 | 0.07 |
| DBE-3 | 35.00 |
| DBE-5 | 52.07 |
| ETHANOL | 3.12 |
| WATER | 3.70 |
| FC-171 | 0.04 |
| **EXAMPLE 51** | |
| DBE-4 | 40.00 |
| ETHANOL | 30.00 |
| N-60 | 10.50 |
| TRIETHANOLAMINE 99 | 1.00 |
| WATER | 10.30 |

-continued

| COMPONENT | WEIGHT PERCENT |
|---|---|
| **EXAMPLE 52** | |
| DBE-4 | 48.00 |
| ETHANOL | 12.00 |
| N-60 | 14.50 |
| TRIETHANOLAMINE 99 | 0.50 |
| WATER | 18.00 |
| **EXAMPLE 53** | |
| DBE-4 | 40.00 |
| ETHANOL | 18.00 |
| N-60 | 3.00 |
| TRIETHANOLAMINE 99 | 0.50 |
| WATER | 38.50 |
| **EXAMPLE 54** | |
| DBE-4 | 20.00 |
| METHANOL | 2.00 |
| ETHANOL | 18.00 |
| GLIDSOL 175 | 1.00 |
| N-60 | 3.00 |
| N-85 | 2.50 |
| TRIETHANOLAMINE 99 | 2.00 |
| WATER | 46.00 |
| **EXAMPLE 55** | |
| DBE-4 | 21.4 |
| METHANOL | 3.00 |
| ETHANOL | 18.00 |
| GLIDSOL 175 | 1.00 |
| N-60 | 3.00 |
| N-85 | 3.00 |
| TRIETHANOLAMINE 99 | 0.60 |
| WATER | 49.00 |
| **EXAMPLE 56** | |
| DBE-4 | 24.90 |
| METHANOL | 3.00 |
| ETHANOL | 13.00 |
| GLIDSOL 175 | 1.00 |
| N-60 | 7.00 |
| N-85 | 3.50 |
| TRIETHANOLAMINE 99 | 0.60 |
| WATER | 47.00 |
| **EXAMPLE 57** | |
| DBE-4 | 19.00 |
| METHANOL | 3.00 |
| ETHANOL | 15.00 |
| GLIDSOL 175 | 1.60 |
| N-60 | 4.40 |
| N-85 | 9.00 |
| TRIETHANOLAMINE 99 | 0.60 |
| WATER | 49.00 |
| **EXAMPLE 58** | |
| DBE-4 | 19.00 |
| METHANOL | 3.00 |
| ETHANOL | 15.00 |
| GLIDSOL 175 | 0.50 |
| N-60 | 4.90 |
| N-85 | 6.00 |
| TRIETHANOLAMINE 99 | 0.50 |
| WATER | 49.00 |
| **EXAMPLE 59** | |
| DBE-4 | 22.00 |
| METHANOL | 1.00 |
| BENZYL ALCOHOL | 7.00 |
| ETHANOL | 14.30 |
| GLIDSOL 175 | 0.70 |
| N-60 | 3.00 |
| N-85 | 3.00 |
| TRIETHANOLAMINE 99 | 1.00 |
| WATER | 48.00 |
| **EXAMPLE 60** | |
| DBE-4 | 19.00 |

-continued

| COMPONENT | WEIGHT PERCENT |
|---|---|
| METHANOL | 2.00 |
| BENZYL ALCOHOL | 6.00 |
| ETHANOL | 14.00 |
| GLIDSOL 175 | 1.00 |
| N-60 | 1.10 |
| N-85 | 1.00 |
| TRIETHANOLAMINE 99 | 6.80 |
| WATER | 49.10 |
| EXAMPLE 61 | |
| DBE-4 | 19.90 |
| BENZYL ALCOHOL | 2.00 |
| ETHANOL | 18.00 |
| GLIDSOL 175 | 1.50 |
| N-60 | 3.00 |
| N-85 | 3.10 |
| TRIETHANOLAMINE 99 | 4.00 |
| WATER | 48.50 |
| EXAMPLE 62 | |
| DBE-4 | 20.00 |
| ETHANOL | 23.00 |
| N-60 | 5.00 |
| N-85 | 3.10 |
| TRIETHANOLAMINE 99 | 0.00 |
| WATER | 51.00 |
| EXAMPLE 63 | |
| ALPHA-TERPINENE (75%) | 6.00 |
| COVI-OX-T-70 | 0.07 |
| DBE-3 | 35.20 |
| DBE-5 | 52.11 |
| ETHANOL | 3.12 |
| WATER | 3.50 |
| FC-171 | 0.04 |
| EXAMPLE 64 | |
| DBE-4 | 20.35 |
| ETHANOL | 23.00 |
| GLIDSOL 175 | 0.25 |
| N-60 | 4.40 |
| WATER | 52.00 |
| EXAMPLE 65 | |
| DBE-4 | 20.50 |
| BENZYL ALCOHOL | 0.30 |
| ETHANOL | 23.00 |
| GLIDSOL 175 | 0.50 |
| N-60 | 4.70 |
| WATER | 51.00 |
| EXAMPLE 66 | |
| DBE-4 | 18.90 |
| BENZYL ALCOHOL | 0.30 |
| ETHANOL | 2.00 |
| GLIDSOL 175 | 23.00 |
| N-60 | 4.70 |
| WATER | 50.00 |
| N-85 | 0.40 |
| EXAMPLE 67 | |
| DBE-4 | 18.90 |
| DBE-5 | 0.50 |
| BENZYL ALCOHOL | 3.00 |
| ETHANOL | 22.00 |
| GLIDSOL 175 | 0.50 |
| N-60 | 4.70 |
| WATER | 50.00 |
| N-85 | 0.40 |
| EXAMPLE 68 | |
| DBE-4 | 18.90 |
| DBE-5 | 0.50 |
| BENZYL ALCOHOL | 3.00 |
| ETHANOL | 23.00 |
| GLIDSOL 175 | 0.50 |
| N-60 | 4.70 |
| WATER | 48.05 |

-continued

| COMPONENT | WEIGHT PERCENT |
|---|---|
| N-85 | 1.35 |
| EXAMPLE 69 | |
| ALPHA-TERPINENE (75%) | 6.00 |
| COVI-OX T-70 | 0.07 |
| DBE-3 | 35.00 |
| DBE-5 | 52.07 |
| ETHANOL | 3.12 |
| WATER | 3.70 |
| FC-171 | 0.04 |
| EXAMPLE 70 | |
| ALPHA-TERPINENE (75%) | 15.00 |
| COVI-OX T-70 | 0.04 |
| GLIDSOL 175 | 0.02 |
| ETHANOL | 3.12 |
| DBE-3 | 39.50 |
| DBE-5 | 39.92 |
| WATER | 2.40 |
| EXAMPLE 72 | |
| ALPHA-TERPINENE (75%) | 13.990 |
| COVI-OX T-70 | 0.040 |
| GLIDSOL 175 | 0.015 |
| ETHANOL | 4.500 |
| DBE-3 | 39.220 |
| DBE-5 | 39.325 |
| WATER | 2.900 |
| FC-171 | 0.01 |
| EXAMPLE 72 | |
| DBE-4 | 19.00 |
| BENZYL ALCOHOL | 7.00 |
| ETHANOL | 23.90 |
| GLIDSOL | 1.00 |
| NINATE 411 | 2.00 |
| WATER | 49.60 |
| AMP | 0.20 |
| EXAMPLE 73 | |
| DBE-4 | 18.00 |
| BENZYL ALCOHOL | 7.50 |
| ETHANOL | 23.90 |
| GLIDSOL | 1.00 |
| NINATE 411 | 2.50 |
| WATER | 46.95 |
| AMP | 0.15 |
| EXAMPLE 74 | |
| DBE-4 | 16.00 |
| BENZYL ALCOHOL | 7.00 |
| ETHANOL | 23.90 |
| GLIDSOL | 1.50 |
| NINATE 411 | 3.00 |
| WATER | 48.55 |
| AMP | 0.05 |
| EXAMPLE 75 | |
| DBE-4 | 15.00 |
| BENZYL ALCOHOL | 7.00 |
| ETHANOL | 24.27 |
| GLIDSOL | 1.20 |
| NINATE 411 | 2.50 |
| WATER | 50.00 |
| AMP | 0.03 |
| EXAMPLE 76 | |
| DBE-4 | 14.00 |
| BENZYL ALCOHOL | 7.00 |
| ETHANOL | 24.27 |
| GLIDSOL | 0.70 |
| NINATE 411 | 3.00 |
| WATER | 51.2 |
| AMP | 0.02 |
| EXAMPLE 77 | |
| DBE-4 | 14.00 |
| BENZYL ALCOHOL | 6.50 |

-continued

| COMPONENT | WEIGHT PERCENT |
|---|---|
| ETHANOL | 24.27 |
| GLIDSOL | 0.50 |
| NINATE 411 | 2.00 |
| WATER | 52.72 |
| AMP | 0.01 |
| EXAMPLE 78 | |
| DBE-4 | 18.00 |
| BENZYL ALCOHOL | 7.50 |
| ETHANOL | 18.00 |
| GLIDSOL | 0.50 |
| NINATE 411 | 2.50 |
| WATER | 53.45 |
| AMP | 0.05 |
| EXAMPLE 79 | |
| DBE-4 | 16.00 |
| BENZYL ALCOHOL | 7.50 |
| ETHANOL | 18.50 |
| GLIDSOL | 0.50 |
| NINATE 411 | 3.40 |
| WATER | 54.07 |
| AMP | 0.03 |
| EXAMPLE 80 | |
| DBE-4 | 14.00 |
| BENZYL ALCOHOL | 4.50 |
| ETHANOL | 17.00 |
| GLIDSOL | 0.25 |
| NINATE 411 | 1.50 |
| WATER | 62.24 |
| AMP | 0.51 |
| EXAMPLE 81 | |
| DBE-4 | 14.00 |
| BENZYL ALCOHOL | 4.50 |
| ETHANOL | 17.00 |
| GLIDSOL | 0.25 |
| NINATE 411 | 1.50 |
| WATER | 62.75 |
| EXAMPLE 82 | |
| DBE-3 | 0.9 |
| DBE-4 | 14.00 |
| BENZYL ALCOHOL | 5.00 |
| ETHANOL | 17.80 |
| GLIDSOL | 0.25 |
| NINATE 411 | 1.50 |
| WATER | 61.35 |
| EXAMPLE 83 | |
| ALPHA-TERPINENE (75%) | 13.920 |
| COVI-OX-70 | 0.040 |
| GLIDSOL 175 | 0.015 |
| ETHANOL | 4.500 |
| DBE-3 | 39.220 |
| DBE-5 | 39.325 |
| WATER | 29.00 |
| FC-430 | 0.08 |
| EXAMPLE 84 | |
| DBE-4 | 27.989 |
| DBE-3 | 5.423 |
| BENZYL ALCOHOL | 0.215 |
| ETHANOL | 23.972 |
| N-60 | 0.833 |
| WATER | 41.577 |
| NINATE 411 | 1.50 |
| EXAMPLE 85 | |
| DBE-4 | 6.00 |
| DBE-3 | 20.00 |
| BENZYL ALCOHOL | 1.00 |
| ETHANOL | 19.75 |
| GLIDSOL 175 | 0.25 |
| BIO-SOFT N-300 | 3.00 |
| WATER | 50.00 |

-continued

| COMPONENT | WEIGHT PERCENT |
|---|---|
| EXAMPLE 87 | |
| DBE-4 | 6.00 |
| DBE-3 | 20.00 |
| BENZYL ALCOHOL | 1.00 |
| ETHANOL | 19.75 |
| GLIDSOL 175 | 0.25 |
| BIO-SOFT N-300 | 3.00 |
| WATER | 50.00 |
| EXAMPLE 87 | |
| DBE-4 | 6.00 |
| DBE-3 | 20.00 |
| BENZYL ALCOHOL | 1.00 |
| ETHANOL | 19.75 |
| GLIDSOL 175 | 0.25 |
| BIO-SOFT N-300 | 3.00 |
| WATER | 50.00 |
| EXAMPLE 88 | |
| DBE-4 | 6.00 |
| DBE-3 | 20.00 |
| BENZYL ALCOHOL | 1.00 |
| ETHANOL | 19.75 |
| GLIDSOL 175 | 0.25 |
| BIO-SOFT N-300 | 3.00 |
| WATER | 50.00 |
| EXAMPLE 89 | |
| DBE-4 | 3.00 |
| DBE-3 | 5.00 |
| BENZYL ALCOHOL | 0.25 |
| ETHANOL | 27.95 |
| MAKON NF-5 | 3.80 |
| WATER | 60.00 |
| EXAMPLE 90 | |
| DBE-4 | 2.68 |
| DBE-3 | 4.30 |
| BENZYL ALCOHOL | 0.22 |
| ETHANOL | 37.90 |
| MAKON NF-5 | 3.20 |
| WATER | 51.70 |
| EXAMPLE 91 | |
| DBE-4 | 3.00 |
| DBE-3 | 5.00 |
| BENZYL ALCOHOL | 0.25 |
| ETHANOL | 27.95 |
| BIOSOFT N-411 | 3.80 |
| WATER | 60.00 |
| EXAMPLE 92 | |
| DBE-4 | 3.00 |
| DBE-3 | 10.00 |
| BENZYL ALCOHOL | 0.25 |
| ETHANOL | 22.95 |
| BIOSOFT N-411 | 3.80 |
| WATER | 60.00 |
| EXAMPLE 93 | |
| DBE-4 | 3.00 |
| DBE-3 | 10.00 |
| BENZYL ALCOHOL | 0.25 |
| ETHANOL | 22.95 |
| MAKON NF-5 | 3.80 |
| WATER | 60.00 |
| EXAMPLE 94 | |
| DBE-4 | 3.00 |
| DBE-3 | 5.00 |
| BENZYL ALCOHOL | 0.25 |
| ETHANOL | 27.95 |
| MAKON NF-5 | 3.30 |
| BIOSOFT N-411 | 1.00 |
| WATER | 59.50 |

-continued

| COMPONENT | WEIGHT PERCENT |
|---|---|
| EXAMPLE 95 | |
| DBE-4 | 2.48 |
| DBE-3 | 9.00 |
| BENZYL ALCOHOL | 0.20 |
| ETHANOL | 34.00 |
| MAKON NF-5 | 3.86 |
| WATER | 50.30 |
| EXAMPLE 96 | |
| DBE-4 | 3.00 |
| DBE-3 | 12.00 |
| BENZYL ALCOHOL | 0.20 |
| ETHANOL | 26.00 |
| MAKON NF-5 | 3.00 |
| WATER | 55.80 |
| EXAMPLE 97 | |
| DBE-4 | 0.018 |
| DBE-3 | 13.750 |
| BENZYL ALCOHOL | 0.090 |
| ETHANOL | 25.000 |
| MAKON NF-5 | 2.749 |
| BIOSOFT N-411 | 2.850 |
| WATER | 59.100 |
| EXAMPLE 98 | |
| DBE-4 | 3.00 |
| DBE-3 | 7.25 |
| BENZYL ALCOHOL | 0.10 |
| ETHANOL | 24.00 |
| BIOSOFT N-411 | 4.65 |
| WATER | 61.00 |
| EXAMPLE 99 | |
| DBE-4 | 0.018 |
| DBE-3 | 11.000 |
| BENZYL ALCOHOL | 0.090 |
| ETHANOL | 26.000 |
| MAKON NF-5 | 3.749 |
| BIOSOFT N-411 | 0.500 |
| WATER | 60.000 |
| EXAMPLE 100 | |
| DBE-4 | 28.448 |
| DBE-3 | 4.846 |
| BENZYL ALCOHOL | 0.192 |
| ETHANOL | 24.232 |
| N-60 | 0.744 |
| WATER | 41.538 |
| EXAMPLE 101 | |
| DBE-4 | 20.000 |
| DBE-3 | 4.846 |
| BENZYL ALCOHOL | 0.192 |
| ETHANOL | 24.232 |
| MAKON 6 | 0.744 |
| WATER | 49.986 |
| EXAMPLE 102 | |
| DBE-4 | 26.872 |
| DBE-3 | 0.472 |
| BENZYL ALCOHOL | 0.181 |
| ETHANOL | 22.889 |
| N-60 | 0.703 |
| WATER | 48.883 |
| EXAMPLE 103 | |
| DBE-4 | 10.332 |
| DBE-3 | 4.000 |
| BENZYL ALCOHOL | 0.100 |
| ETHANOL | 23.000 |
| N-60 | 3.000 |
| WATER | 59.568 |
| EXAMPLE 104 | |
| DBE-4 | 17.954 |
| DBE-3 | 3.168 |

-continued

| COMPONENT | WEIGHT PERCENT |
|---|---|
| BENZYL ALCOHOL | 0.308 |
| ETHANOL | 23.763 |
| N-60 | 0.680 |
| Makon 8 | 0.106 |
| WATER | 54.021 |
| EXAMPLE 105 | |
| DBE-4 | 17.000 |
| DBE-3 | 3.000 |
| BENZYL ALCOHOL | 0.292 |
| ETHANOL | 22.500 |
| N-60 | 0.644 |
| Makon 8 | 0.100 |
| WATER | 56.464 |
| EXAMPLE 106 | |
| DBE-4 | 18.126 |
| DBE-3 | 3.198 |
| BENZYL ALCOHOL | 0.204 |
| ETHANOL | 23.458 |
| N-60 | 0.633 |
| Makon 8 | 0.160 |
| WATER | 54.219 |
| EXAMPLE 107 | |
| DBE-4 | 16.000 |
| DBE-3 | 3.000 |
| BENZYL ALCOHOL | 0.192 |
| ETHANOL | 24.232 |
| N-60 | 0.400 |
| Makon 8 | 0.444 |
| WATER | 55.732 |
| EXAMPLE 108 | |
| DBE-4 | 14.000 |
| DBE-3 | 5.000 |
| BENZYL ALCOHOL | 0.192 |
| ETHANOL | 23.800 |
| N-60 | 0.644 |
| Makon 8 | 0.300 |
| WATER | 56.064 |
| EXAMPLE 109 | |
| DBE-4 | 16.000 |
| DBE-3 | 3.000 |
| BENZYL ALCOHOL | 0.192 |
| ETHANOL | 21.000 |
| N-60 | 0.300 |
| Makon 8 | 0.444 |
| WATER | 59.064 |
| EXAMPLE 110 | |
| DBE-4 | 16.000 |
| DBE-3 | 3.000 |
| BENZYL ALCOHOL | 0.192 |
| ETHANOL | 24.232 |
| N-60 | 0.300 |
| Makon 8 | 0.444 |
| WATER | 55.832 |
| EXAMPLE 111 | |
| DBE-4 | 20.000 |
| DBE-3 | 3.000 |
| BENZYL ALCOHOL | 0.192 |
| ETHANOL | 24.232 |
| N-60 | 0.500 |
| Makon 8 | 0.244 |
| WATER | 51.832 |
| EXAMPLE 112 | |
| DBE-3 | 17.954 |
| DBE-4 | 3.168 |
| BENZYL ALCOHOL | 0.308 |
| ETHANOL | 23.763 |
| N-60 | 0.900 |
| WATER | 53.907 |

-continued

| COMPONENT | WEIGHT PERCENT |
|---|---|
| EXAMPLE 113 | |
| DBE-4 | 14.000 |
| DBE-3 | 5.000 |
| BENZYL ALCOHOL | 0.192 |
| ETHANOL | 22.000 |
| N-60 | 0.150 |
| WATER | 58.000 |
| EXAMPLE 114 | |
| DBE-4 | 9.000 |
| DBE-3 | 4.500 |
| BENZYL ALCOHOL | 0.100 |
| ETHANOL | 24.232 |
| N-60 | 2.600 |
| WATER | 59.568 |
| EXAMPLE 115 | |
| DBE-4 | 12.332 |
| DBE-3 | 3.000 |
| BENZYL ALCOHOL | 0.100 |
| ETHANOL | 22.000 |
| N-60 | 3.000 |
| WATER | 59.568 |
| EXAMPLE 116 | |
| DBE-4 | 12.000 |
| DBE-3 | 4.500 |
| BENZYL ALCOHOL | 0.100 |
| ETHANOL | 24.000 |
| Makon 4 | 0.250 |
| N-60 | 0.200 |
| WATER | 58.450 |
| EXAMPLE 117 | |
| DBE-4 | 17.000 |
| DBE-3 | 0.250 |
| BENZYL ALCOHOL | 0.050 |
| ETHANOL | 22.000 |
| N-60 | 0.450 |
| WATER | 60.250 |
| EXAMPLE 118 | |
| DBE-4 | 15.000 |
| DBE-3 | 1.000 |
| BENZYL ALCOHOL | 0.100 |
| ETHANOL | 22.500 |
| N-60 | 3.000 |
| WATER | 58.400 |
| EXAMPLE 119 | |
| DBE-4 | 16.000 |
| DBE-3 | 3.000 |
| BENZYL ALCOHOL | 0.192 |
| ETHANOL | 22.000 |
| N-60 | 0.800 |
| Makon 8 | 0.244 |
| WATER | 57.964 |
| EXAMPLE 120 | |
| DBE-4 | 20.000 |
| DBE-3 | 3.000 |
| BENZYL ALCOHOL | 0.192 |
| ETHANOL | 24.232 |
| N-60 | 0.700 |
| Makon 10 | 0.044 |
| WATER | 51.823 |
| EXAMPLE 121 | |
| DBE-4 | 17.000 |
| DBE-3 | 3.000 |
| BENZYL ALCOHOL | 0.192 |
| ETHANOL | 23.000 |
| Makon 4 | 0.644 |
| Makon 10 | 0.100 |
| WATER | 56.064 |
| EXAMPLE 122 | |
| DBE-4 | 7.000 |
| DBE-3 | 5.000 |
| BENZYL ALCOHOL | 0.100 |
| ETHANOL | 23.900 |
| N-60 | 3.000 |
| WATER | 61.000 |
| EXAMPLE 123 | |
| DBE-4 | 17.000 |
| DBE-3 | 3.000 |
| BENZYL ALCOHOL | 0.192 |
| ETHANOL | 22.000 |
| N-60 | 0.500 |
| Makon 10 | 0.244 |
| WATER | 57.064 |

Results

After making and analyzing the above examples, the following conclusions emerged:

1. The inclusion of dibasic ester provided a good cleaning action for fatty acids and other hydrophobic contaminants in the textiles. As larger quantities of dibasic ester were added to the formulations, the cleaning compositions became more aggressive, i.e., they were more easily able to remove hydrophobic contaminants quickly. However, the aggressiveness associated with increased dibasic esters tended to produce certain untoward results in certain types of fabric, particularly with rayon acetate normally found in liners in women's apparel. Most of the other fabrics were unaffected, however. The use of a mixture of DBE-4 to DBE-3 (lower levels of perhaps 5% to about 20% and a ratio of DBE-4 to DBE-3 which was preferably about 1:1 or higher) were preferred for providing better properties with respect to cleaning efficiency and distillability which are compatible with today's dry cleaning machines and processes. Higher concentrations of the DBE's are useful when there is a need for a more aggressive cleaning composition (heavy soil and grease) and the underlying textiles to be cleaned are not rayon acetates or similar textiles which are affected by the inclusion of the dibasic esters.
2. The inclusion of a hydrophilic alcohol was found to be advantageous for compatibilizing the dibasic esters and water as well as enhancing the distillability of the final composition. Some enhanced removal of more hydrophilic components would be expected with the inclusion of alcohol. Better compositions are obtained using ethanol or a mixture of methanol and ethanol at levels of about 20% to about 30% by weight.
3. The nonylphenol ethoxylate surfactants are the preferred surfactants because of their ability to accommodate the other components of the cleaning composition and their ability to expunge water from the compositions after a certain amount of water is reached in the compositions. HLB value of the nonylphenolethoxylate surfactants is an important consideration for providing a cleaning composition which expunges water. A HLB value close to 11 appeared to be the most workable in the experiments performed.
4. Water was also added advantageously to the compositions at a level preferably ranging from about 40% to about 60–65% by weight of the compositions. At this level of water and levels of about 50% or more within this range, the compositions provided good cleaning efficiency, generally acceptable distillation temperatures and competitive manufacturing cost to make these compositions viable alternatives to perchlorethylene.

5. The inclusion of benzyl alcohol at low levels, preferably less than about 5% and even more preferably less than about 0.5%, provided a benefit in cleaning efficiency as well as distillation.

It is to be understood that the examples and embodiments described hereinabove are for the purposes of providing a description of the present invention by way of example and are not to be viewed as limiting the present invention in any way. Various modifications or changes that may be made to that described hereinabove by those of ordinary skill in the art using equivalents of components specifically described in the present invention are also contemplated by the present invention and are to be included within the spirit and purview of this application and the following claims.

I claim:

1. A composition for use as a cleaning or degreasing composition consisting essentially of:

i. about 3% to about 95% by weight of at least one dibasic ester, selected from the group consisting of dimethyl adipate, dimethyl glutarate, dimethyl succinate and mixtures thereof;

ii. about 5% to about 50% by weight of a hydrophilic alcohol selected from the group consisting of methanol, ethanol, propanol and isopropanol;

iii. about 0% to about 10% by weight of at least one phenyl-substituted benzyl alcohol according to the general structure:

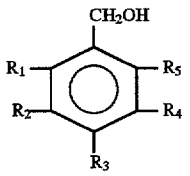

where $R_1$–$R_5$ are H or $C_1$–$C_5$ alkyl.

iv. about 0% to about 20% by weight of a terpene compound;

v. about 0.001% to about 15% by weight of a surfactant; and vi. about 3% to about 75% by weight water.

2. A reconstituting composition for use in reconstituting a cleaning composition which has been subjected to distillation, said reconstituting composition consisting essentially of:

a. about 10% to about 94.5% by weight of at least one dibasic ester selected from the group consisting of dimethyl adipate, dimethyl glutarate, dimethyl succinate and mixtures thereof;

ii. about 5% to about 40% by weight of a hydrophilic alcohol selected from the group consisting of ethanol, methanol and isopropanol;

iii. about 0% to about 10% by weight of benzyl alcohol; and iv. about 0.5% to about 85% by weight of a surfactant.

3. The composition according to claim 1 wherein said dibasic ester is a mixture selected from at least two of the group consisting of dimethyl adipate, dimethyl glutarate and dimethyl succinate.

4. The composition according to claim 3 wherein said dibasic ester is a mixture of dimethyl succinate and dimethyl adipate.

5. The composition according to claim 4 wherein said mixture includes dimethyl succinate and dimethyl adipate in a weight ratio of about 6.0:1 to about 1:1.

6. The composition according to claim 5 wherein said mixture is included in an amount ranging from about 7.5% to about 35% by weight.

7. The composition according to claim 4 wherein said hydrophilic alcohol is selected from the group consisting of ethanol, methanol and isopropanol.

8. The composition according to claim 7 wherein said hydrophilic alcohol is ethanol included in said composition in an amount ranging from about 15% to about 45% by weight.

9. The composition according to claim 1 wherein $R_1$–$R_5$ are H and said phenyl-substituted benzyl alcohol is included in said composition in an amount ranging from 0.05% to about 5% by weight.

10. The composition according to claim 1 wherein said terpene compound is selected from alpha-terpinene and terpineol.

11. The composition according to claim 7 wherein said water is included in an amount of at least about 10% by weight.

12. The composition according to claim 11 wherein said water is included in an amount ranging from about 10% to about 65% by weight.

13. The composition according to claim 12 wherein said water is included in an amount ranging from about 30% to about 60% by weight.

14. The composition according to claim 12 wherein said surfactant is alkylphenolethoxylate surfactant included in an amount ranging from about 0.2% to about 5% by weight.

15. The composition according to claim 13 wherein said surfactant is a nonylphenolethoxylate surfactant included in an amount ranging from about 0.5% to about 5% by weight.

16. The composition according to claim 13 wherein said nonylphenolethoxylate surfactant is Alpha-(Nonylphenyl)-Omega-Hydroxy-Poly(Oxy-1,2-ethanediyl) having an HLB value ranging from about 8 to about 12 and being included in said composition in an amount ranging from about 1.0% to about 3% by weight.

17. The composition according to claim 1 wherein said dibasic ester consists essentially of a mixture of dimethyl succinate and dimethyl adipate in a ratio of about 3:1 to about 1:1, said mixture consisting essentially of about 5% to about 20% by weight of said composition, said hydrophilic alcohol is ethanol consisting essentially of about 10% to about 40% by weight, said phenyl-substituted benzyl alcohol is benzyl alcohol consisting essentially of about 0% to about 2% by weight of said composition, said surfactant is a nonylphenolethoxylate surfactant consisting essentially of about 0.5% to about 5% by weight of said composition and having an HLB value ranging from about 10 to about 11.5 and said water consists essentially of about 45% to about 60% by weight of said composition.

18. A composition for use as a cleaning or degreasing composition comprising consisting essentially of:

i. about 5% to about 50% by weight of at least one dibasic ester selected from the group consisting of dimethyl adipate, dimethyl glutarate, dimethyl succinate and mixtures thereof;

ii. about 10% to about 45% by weight of a hydrophilic alcohol selected from the group consisting of ethanol, methanol and isopropanol;

iii. about 0% to about 10% by weight of benzyl alcohol;

iv. about 0% to about 15% by weight of a terpene compound selected from alpha-terpinene and terpineol;

v. about 0.2% to about 10% by weight of a surfactant; and vi. about 10% to about 65% by weight water.

19. The composition according to claim 18 wherein said dibasic ester is selected from a mixture of dimethyl adipate, dimethyl glutarate and dimethyl succinate.

20. The composition according to claim 19 wherein said dibasic ester is a mixture of dimethyl succinate and dimethyl adipate.

21. The composition according to claim 20 wherein said dimethyl succinate and dimethyl adipate are included in said composition in a weight ratio of about 6.0:1 to about 1:1.

22. The composition according to claim 21 wherein said mixture is included in an amount ranging from about 5% to about 20% by weight.

23. The composition according to claim 21 wherein said hydrophilic alcohol is ethanol included in said composition in an amount ranging from about 20% to about 40% by weight.

24. The composition according to claim 19 wherein said water is included in an amount ranging from about 45% to about 60% by weight.

25. The composition according to claim 23 wherein said water is included in an amount ranging from about 45% to about 55% by weight.

26. The composition according to claim 23 wherein said water is included in an amount ranging from about 30% to about 60% by weight.

27. The composition according to claim 26 wherein said surfactant is alkylphenolethoxylate surfactant included in an amount ranging from about 0.2% to about 5% by weight.

28. The composition according to claim 24 wherein said surfactant is a nonylphenolethoxylate surfactant included in an amount ranging from about 0.5% to about 5% by weight.

29. The composition according to claim 28 wherein said nonylphenolethoxylate surfactant is Alpha-(Nonylphenyl)-Omega-Hydroxy-Poly(Oxy-1,2-ethanediyl) having an HLB value ranging from about 8 to about 12 and being included in said composition in an amount ranging from about 1.0% to about 3% by weight.

30. The composition according to claim 18 wherein said dibasic ester consists essentially of a mixture of dimethyl succinate and dimethyl adipate in a ratio of about 3:1 to about 1.5:1, said mixture consisting essentially of about 5% to about 20% by weight of said composition, said hydrophilic alcohol is ethanol, isopropanol or a mixture of ethanol and isopropanol consisting essentially of about 10% to about 40% by weight, said benzyl alcohol consists essentially of about 0% to about 0.5% by weight of said composition, said surfactant is a nonylphenolethoxylate surfactant having an HLB value ranging from about 10 to about 11.5 and consisting essentially of about 0.5% to about 3% by weight of said composition and said water consists essentially of about 45% to about 60% by weight of said composition.

31. The composition according to claim 2 further including about 2% to about 50% water.

* * * * *